US006523766B1

(12) United States Patent
Watt

(10) Patent No.: US 6,523,766 B1
(45) Date of Patent: Feb. 25, 2003

(54) PORTABLE PILL CRUSHING DEVICE

(76) Inventor: Richard A. Watt, 20 Giardina Rd., Saugerties, NY (US) 12477

( * ) Notice: Subject to any disclaimer, the term of this patent is extended or adjusted under 35 U.S.C. 154(b) by 0 days.

(21) Appl. No.: 09/663,529

(22) Filed: Sep. 15, 2000

(51) Int. Cl.[7] ..... B02C 19/08

(52) U.S. Cl. ..... 241/262; 241/100; 241/101.2; 241/DIG. 27

(58) Field of Search ..... 241/101.2, 100, 241/262, DIG. 27

(56) References Cited

U.S. PATENT DOCUMENTS 2,668,668 A 2/1954 Doschek
5,067,666 A 11/1991 Sussman
5,472,421 A 12/1995 Klearman et al.
5,531,386 A 7/1996 Jensen
5,863,001 A 1/1999 Schulze
5,915,637 A * 6/1999 Parsons ..... 241/168

FOREIGN PATENT DOCUMENTS

JP 6156606 6/1994

* cited by examiner

*Primary Examiner*—William Hong
(74) *Attorney, Agent, or Firm*—Schmeiser, Olsen & Watts

(57) ABSTRACT

The present invention relates generally to a crushing device. More particularly, the present invention relates to providing a portable pill crushing device for pulverizing medicines that are supplied in the form of pills, tablets, etc. The pill is automatically sealed within a bag and is pulverized and delivered to a practitioner.

18 Claims, 6 Drawing Sheets

PORTABLE PILL CRUSHING DEVICE

FIELD OF THE INVENTION

The present invention relates generally to a crushing device. More particularly, the present invention relates to providing a pill crushing device for crushing medicines that are supplied in the form of pills, tablets, etc.

BACKGROUND OF THE INVENTION

Many medicines and nutrients are provided in pill form. Unfortunately, many patients have difficulty in swallowing a pill. This is especially true in youth or geriatric environments. Likewise, comatose or physically impaired patients are not able to swallow the pills. Typically, a health practitioner such as a nurse must crush or pulverize the pill. Commonly, the nurse must place the pill in a mortar and must repeatedly beat the pill with a hammer to crush the pill. This technique has many drawbacks. The pill is crushed in the mortar into a powder and must be transferred to another container before being administered to the patient. Even with extreme care, some powder is left on the mortar, so that the patient does not receive a full dose. There is also unavoidable cross-contamination as the same mortar is reused for other patients. The powder may also be placed in the container that has an incorrect patient name, so that the wrong patient may receive the crushed medication. The technique is also time consuming using valuable and costly nurse time. During pounding, some of the fine powder becomes airborne and the nurse may inhale or come in contact with a variety of toxic compounds. Additionally, the nurse may receive physical injury to various body parts (e.g., arms, hands, tendons, etc.) due to the repeated pounding inflicted upon the body parts.

SUMMARY OF THE INVENTION

The present invention provides a pill crushing device that automatically pulverizes the pill within a sealed bag. The pill(s) are dropped into a top opening in the pill crushing device, sealed in the sealed package, crushed, and delivered through an exit opening to a practitioner such as a nurse.

BRIEF DESCRIPTION OF THE DRAWINGS

The features of the present invention will best be understood from a detailed description of the invention selected for the purposes of illustration and shown in the accompanying drawings in which.

DETAILED DESCRIPTION OF THE INVENTION

Figure 1:
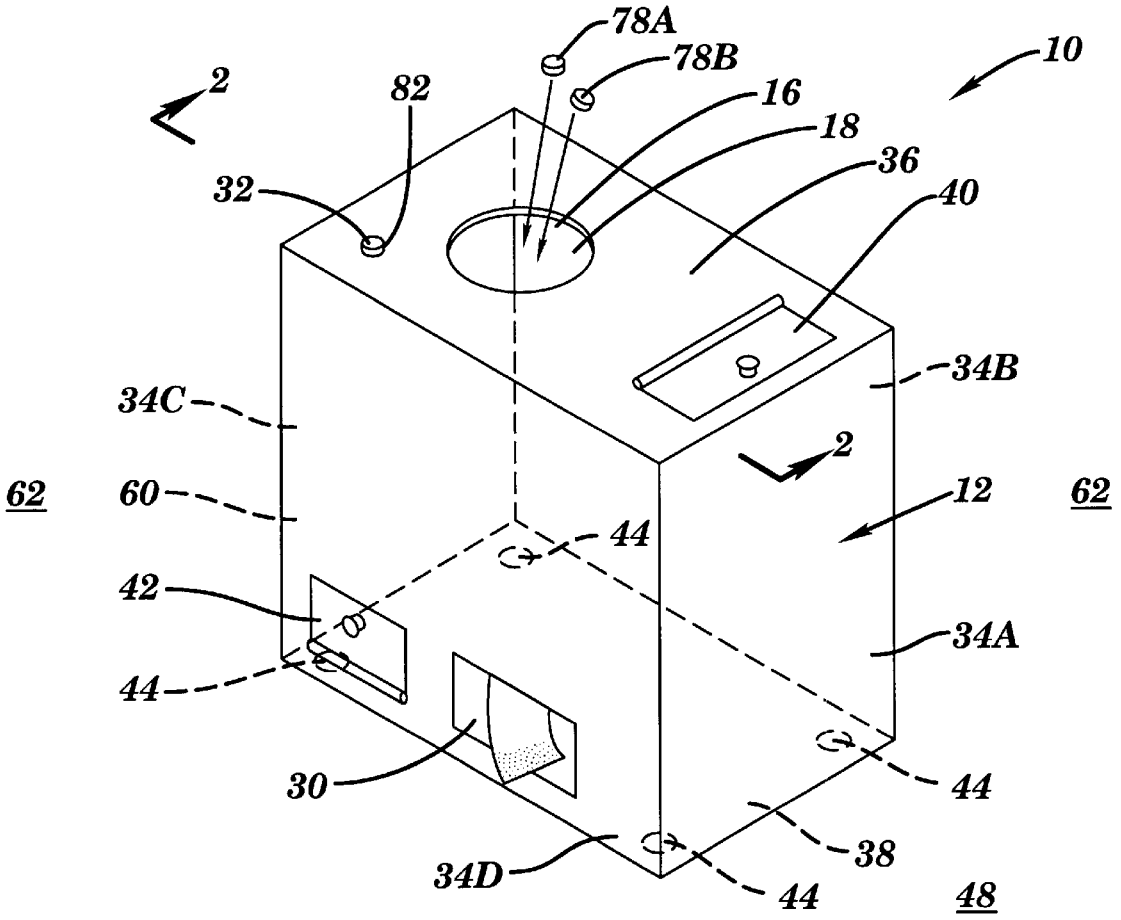
FIG. 1 illustrates a perspective view of a portable pill crushing device.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., which are disclosed simply as an example of the embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

Figure 2:
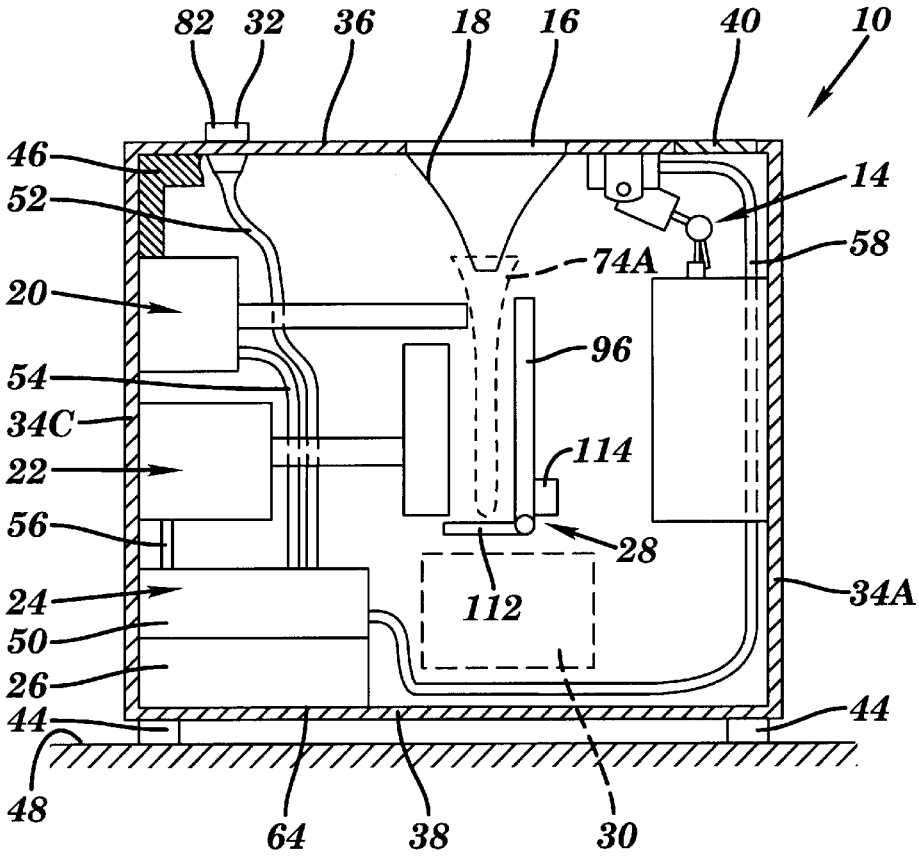
FIG. 2 illustrates a cross-sectional view of the portable pill crushing device taken along line 2—2 of FIG. 1.

FIG. 1 illustrates a perspective view of a portable pill crushing device 10. FIG. 2 illustrates a cross-sectional view taken along line 2—2 of FIG. 1. The portable pill crushing device 10 includes a housing 12, a bag dispensing system 14, an inlet opening 16, a delivery funnel 18, a bag closing system 20, a crushing system 22, a control system 24, a power supply 26, a discharge system 28, a discharge opening 30, and a control switch 32. The housing 12 includes a plurality of sides 34A, 34B, 34C, and 34D.

The housing also includes a top 36, a bottom 38, a bag access door 40, and a battery access door 42. A plurality of feet 44 may be attached to the bottom outside surface 64 bottom 38 of the housing 12. The feet 44 may include a resilient material (e.g., rubber, plastic, etc.) to reduce slipping and vibration between the bottom 38 of the housing and a support surface 48. A noise reduction material 46 may be attached to the inner surfaces of the sides 34A, 34B, 34C, 34D, and the top 36 and the bottom 38 of the housing 12. The noise reduction material 46 may include (e.g., fiberglass, acoustic tile, etc.). The noise reduction material 46 attenuates the noise that is transmitted from the inside 60 of the housing 12 to the outside 62 of the housing 12.

The power supply 26 may include any suitable energy source (e.g., batteries, rechargeable batteries, 110V power supply, etc.). The battery access door 42 may be opened to allow batteries to be replaced within the power supply 26. The power supply 26 connects to the control system 24 and supplies power to the control system 24. The control system 24 may include a microprocessor 50. A conduit 52 connects the control system 24 with the control switch 32. A conduit 54 connects the control system 24 with the bag closing system 20. A conduit 56 connects the control system 24 with the crushing system 22. A conduit 58 connects the control system 24 with the bag dispensing system 14. The conduits 54, 56, and 58 allow the control system to send electrical power at the appropriate times to the bag closing system 20, the crushing system 22, and the bag dispensing system 14, respectively.

Figure 3:
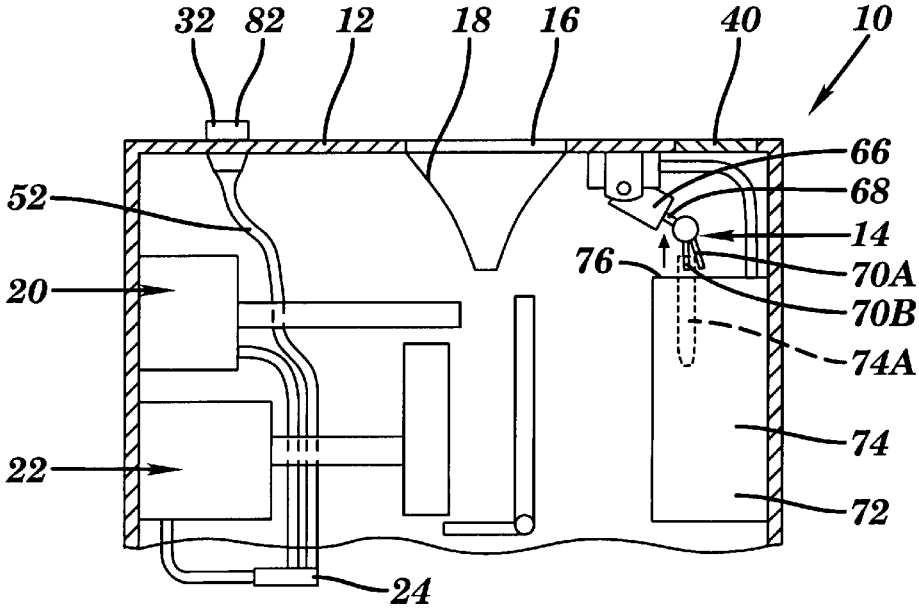
FIG. 3 illustrates a partial cross-sectional view of a bag dispensing system acquiring a bag from a bag dispenser.
Figure 4:
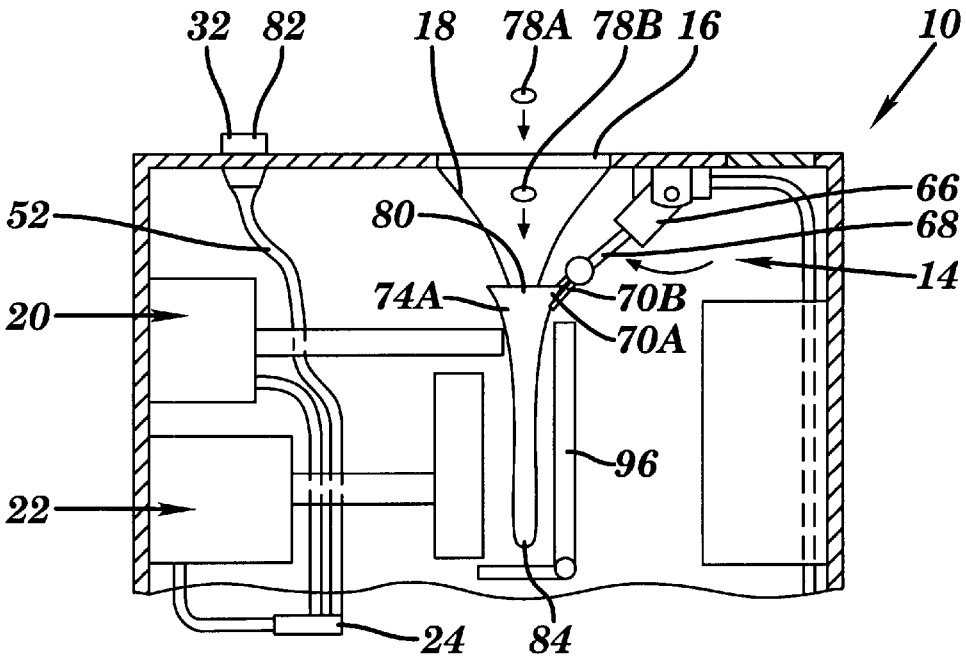
FIG. 4 illustrates a partial cross-sectional view of the bag dispensing system holding the bag beneath a delivery funnel and a plurality of objects falling through the delivery funnel into the bag.

FIG. 3 illustrates a partial cross sectional view of the portable pill crushing device 10 including the bag dispensing system 14, and the control switch 32. A practitioner depresses the control switch 32 to start an object 78A crushing and bagging cycle. The object 78A may be any suitable object to be pulverized (e.g., pill, tablet, foods, nutriments, etc.). Depressing the control switch 32 sends a signal to the control system 24 through the conduit 52. The bag dispensing system 14 includes an actuating system 66 and a bag dispenser 72. The actuating system 66 includes an arm 68 and a finger 70A and a finger 70B. The bag dispenser 72 stores a plurality of bags 74. The bags 74 may include any suitable material (e.g., plastic, polyethylene, polypropylene, anti-static, foil, paper, etc.). One bag 74A at a time projects from the top 76 of the bag dispenser 72. The fingers 70A and 70B grasp the bag 74A. The bag 74A is pulled out of the bag dispenser 72 and the actuating system 66 transfers the bag 74A to encircle a lower opening 80 of the delivery funnel 18 (FIG. 4). The fingers 70A and 70B continue to grasp the bag 74A. When the bag 74A is in this position, a light 82 in the control switch 32 is activated by the control system 24. The light 82 illuminates and alerts the practitioner that an object 78A may be deposited through the opening 16 of the delivery funnel 18. Then a plurality of objects such as 78A and 78B, etc., may be deposited through the opening 16 into the delivery funnel 18 (FIGS. 1 and 4). The objects 78A and 78B drop to a lower portion 84 of the bag 74A as illustrated in FIG. 5.

Figure 5:
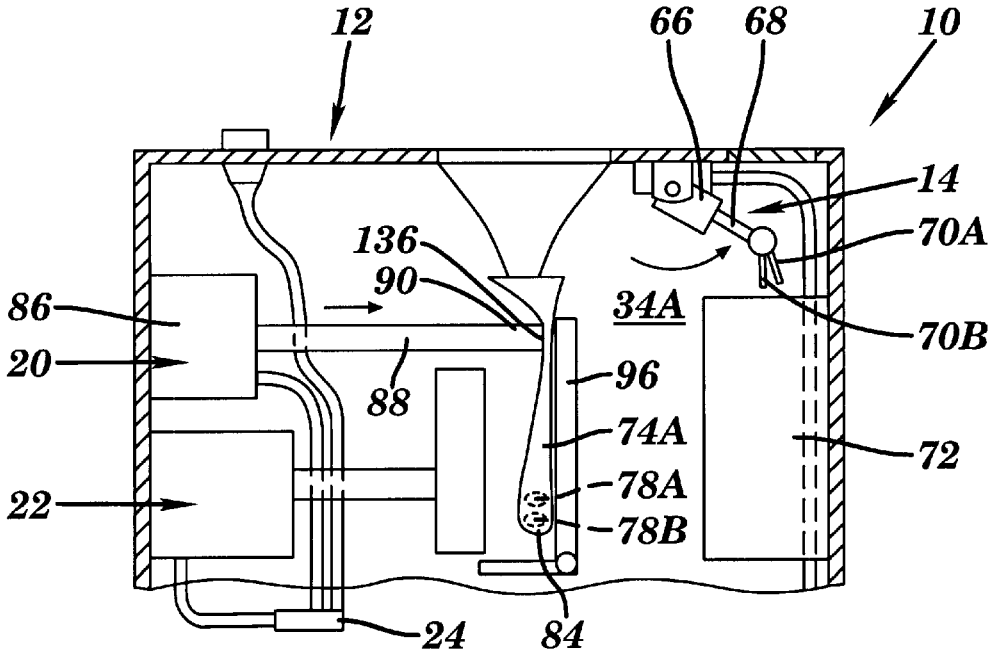
FIG. 5 illustrates a partial cross-sectional view of a bag closing system sealing an opening in the bag.
Figure 11:
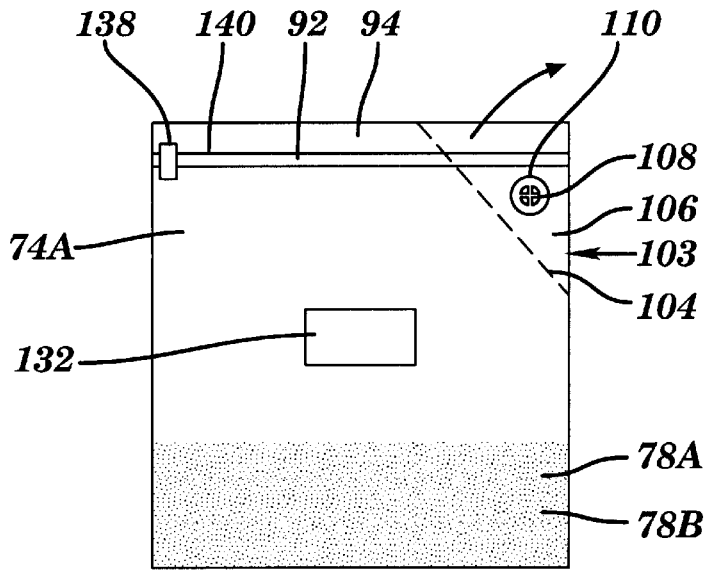
FIG. 11 illustrates a side view of the bag including a gas vent including perforations in the bag.

FIG. 5 illustrates the bag 74A sealing process of the objects 78A and 78B. The bag closing system 20 includes an actuator 86, an arm 88, and a sealing apparatus 90. The sealing apparatus 90 is attached to the arm 88. The bag 74A may include any suitable closing means (zipper, heat seal, adhesive, etc.) to close a top opening 94 in the bag 74A along a sealing line 92 as illustrated in FIG. 11. The sealing apparatus 90 may include any suitable device (heat sealer, zipper closer, etc.) to close the bag 74A along the sealing line 92. When a zipper closure 140 is used, the sealing apparatus 90 may include a tab grasping device 136 for gripping a zipper tab 138 on the zipper closure 140 (FIGS. 5 and 11). Before and during sealing, the fingers 70A and 70B continue to grasp the bag 74A as illustrated in FIG. 4. The actuator 86 extends, retracts, and moves the sealing apparatus 90 along the sealing line 92. The sealing apparatus 90 closes the bag along the sealing line 92 which closes the top opening 94 in the bag 74A (FIG. 11). Thus, the objects 78A and 78B are encased within the bag 74A. A plate 96 is attached to the side 34A of the housing 12 (FIG. 5). After sealing, the sealing apparatus 90 applies pressure toward the plate 96. The bag 74A is trapped and held between the sealing apparatus 90 and the plate 96. Then the fingers 70A and 70B of the bag dispensing system 14 are released from the bag 74A and the actuating system 66 swings the fingers 70A and 70B into position above the bag dispenser 72 (FIG. 5).

Figure 6:
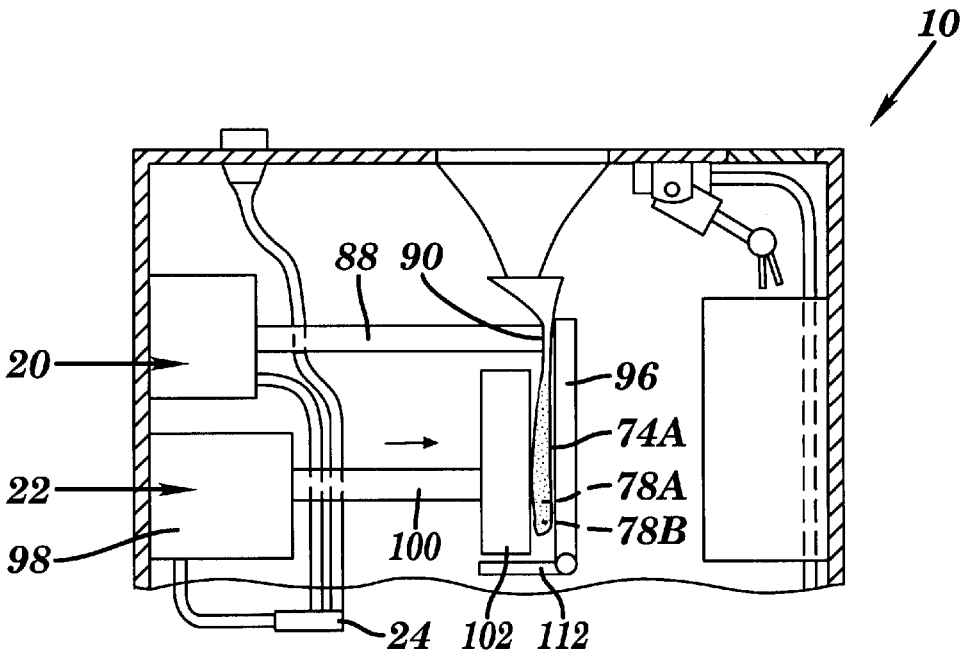
FIG. 6 illustrates a partial cross-sectional view of a crushing system pulverizing the objects in the bag.

FIG. 6 illustrates the crushing system 22. The crushing system 22 includes a force actuator 98, a thrust arm 100, and a mallet 102. The mallet 102 is attached to the thrust arm 100. The force actuator 98 extends and retracts the thrust arm 100. The mallet 102 presses against the bag 74A, the objects 74A and 74B, and the plate 96. The pressure against the objects 74A and 74B pulverize the objects 74A and 74B into a powder within the bag 74A. The mallet 102 may apply a single force or may repeatedly impact the objects 74A and 74B until they are completely pulverized. Then the mallet 102 is moved away from the bag 74A.

FIG. 11 illustrates the bag 74A including a gas vent 103. The gas vent 103 may include a plurality of perforations 104. The perforations 104 allow gas to escape from within the bag 74A when the bag 74A is squeezed. This prevents the gas pressure from building up within the bag 74A to a pressure level that would cause the bag 74A to rupture. During the crushing process, the sealing apparatus 90 maintains a force towards the plate 96, so that the bag 74A continues to be gripped between the sealing apparatus 90 and the plate 96. Additionally, a trap door 112 is in a closed position that also prevents the bag 74A from falling (FIG. 6).

Figure 8:
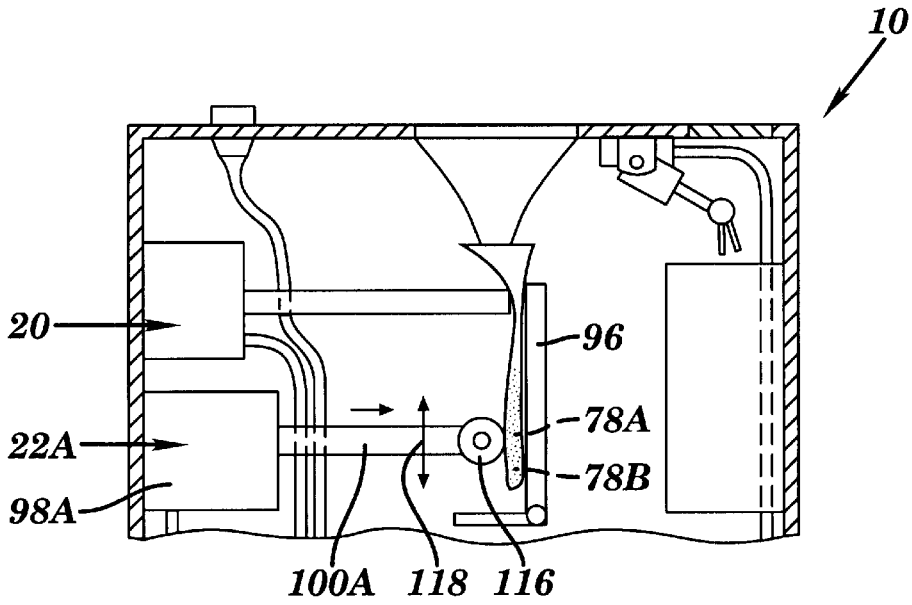
FIG. 8 illustrates a partial cross-sectional view of another embodiment of the crushing system.

Another embodiment of the crushing system 22A is illustrated in FIG. 8. The crushing system 22A includes an actuator 98A, a thrust arm 100A, and a roller 116. The roller 116 is rotationally attached to the thrust arm 100A. The actuator 98A extends the trust arm 100A until the roller 116 is crushing the objects 78A and 78B. Then the actuator 98A repeatedly moves the roller 116 back and forth in a vertical direction 118 until the objects 78A and 78B are completely pulverized.

Figure 7:
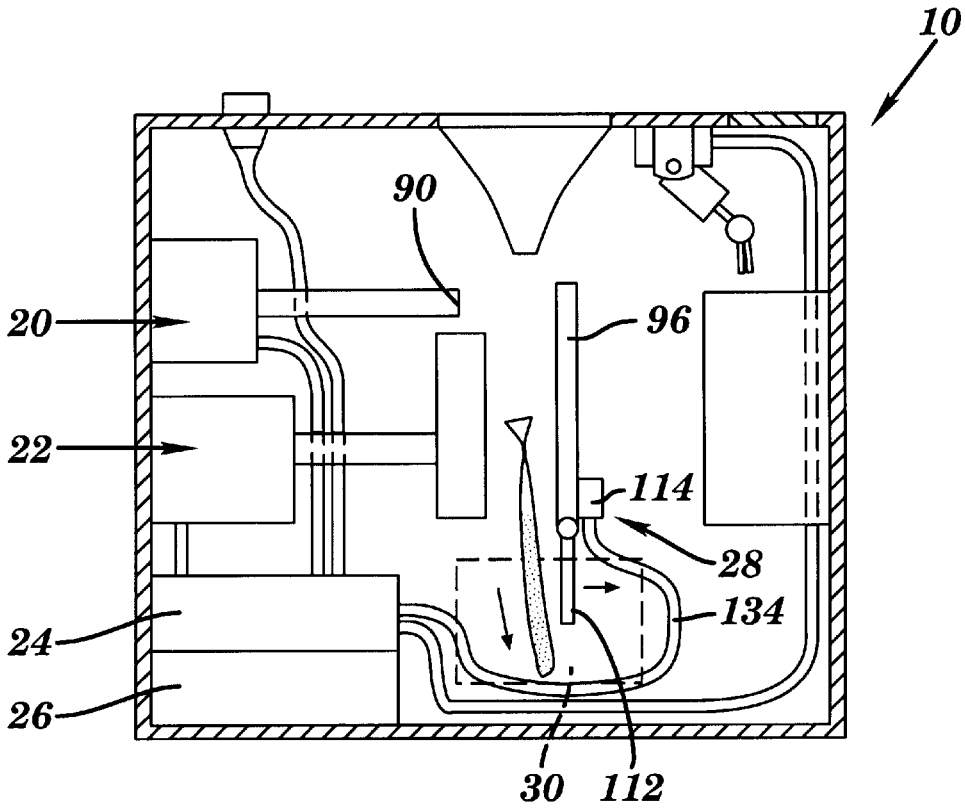
FIG. 7 illustrates a partial cross-sectional view of a discharge system releasing the bag.

FIG. 7 illustrates the discharge system 28. The discharge system 28 includes the trap door 112, a door actuator 114, and the discharge opening 30. The trap door 112 is pivotally attached to the plate 96. To release the bag 74A, the control system 24 sends a signal to the bag closing system 20 to move the sealing apparatus 90 away from the bag 74A, and the control system 24 sends a signal through a conduit 134 to the actuator 114. The actuator 114 then rotates the trap door 112 into a vertical position (FIG. 7). The bag 74A is free to fall into the discharge opening 30 in the housing 12. The practitioner may remove the bag 74A containing the pulverized objects 78A and 78B from the discharge opening 30 in the housing 12. The bag 74A may include a label portion 132 that may be written upon. This allows the practitioner to write pertinent information (e.g., patient's name, medication names, dosage, date, time, etc.) as illustrated in FIG. 11.

Figure 12:
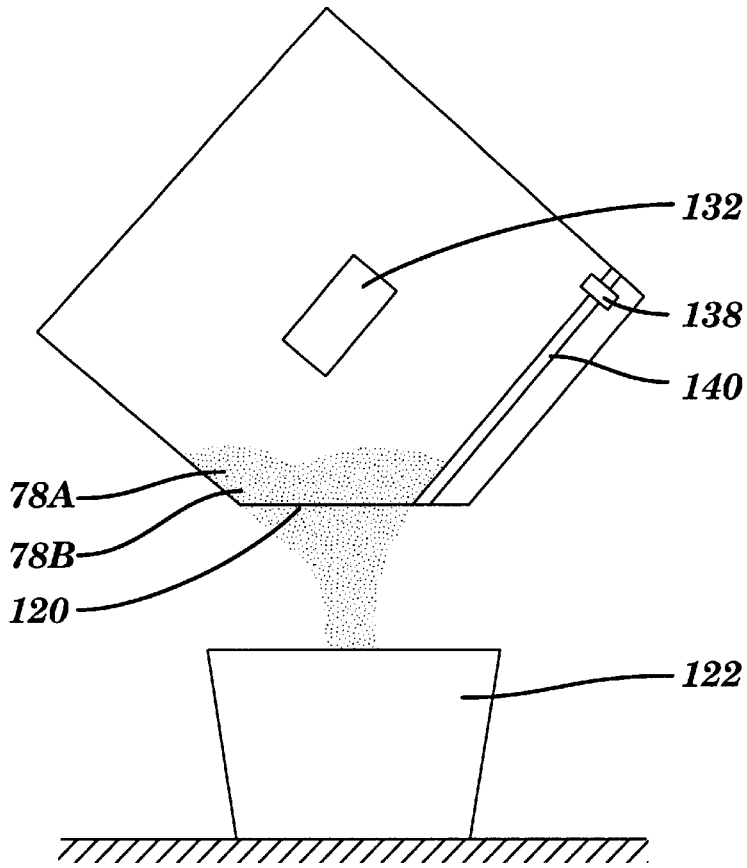
FIG. 12 illustrates a side view of the bag with the pulverized objects being poured into a container.

As illustrated in FIG. 11, the perforations 104 may lie in a straight line that allows the practitioner to pull the tear off portion 106 away from the bag 74A. An opening 120 is created in the bag 74A (FIG. 12). A grip portion 108 including a plurality of raised protrusions 110 may be included on the bag 74A. The grip portion 108 provides a non-slippery surface that the practitioner may easily grasp and pull. As illustrated in FIG. 12, the practitioner may pour the pulverized objects 78A and 78A through the opening 120 into a container 122.

Figure 9:
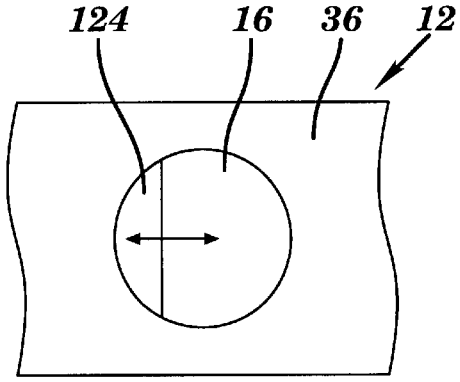
FIG. 9 illustrates a plan view of a door apparatus including a slide plate cover for covering and uncovering an inlet opening in a housing of the portable pill crushing device.

Another embodiment of the inlet opening 16 in the housing 12 includes a slide plate cover 124 as illustrated in FIG. 9. The slide plate cover 124 normally covers the inlet opening 16. When closed, the slide plate cover 124 prevents dirt or contaminants from entering the opening 16 in the housing 12. The slide plate cover 124 is automatically opened when the bag 74A is in position to receive the objects 78A and 78B as illustrated in FIG. 4.

Figure 10:
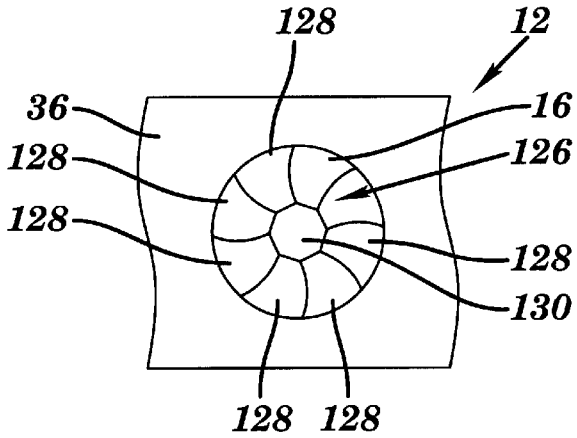
FIG. 10 illustrates a plan view of another embodiment of the door apparatus including a shutter apparatus.

Another embodiment of the inlet opening 16 in the housing 12 includes a shutter apparatus 126 as illustrated in FIG. 10. The shutter apparatus 126 includes a plurality of shutter blades 128. The shutter blades 128 move and contract or expand an aperture 130. The aperture 130 may close so that the opening 16 is fully covered. The aperture is opened when the bag 74A is in position to receive the objects 78A and 78B as illustrated in FIG. 4.

The foregoing description of the present invention has been presented for purposes of illustration and description. It is not intended to be exhaustive or to limit the invention to the precise form disclosed, and many modifications and variations are possible in light of the above teaching. For example, the portable pill crushing device 10 may be used to bag and pulverize into a powder any suitable solid objects 78 (e.g., pill, tablet, foods, nutrients, etc.). Such modifications and variations that may be apparent to a person skilled in the art are intended to be included within the scope of this invention as defined by the accompanying claims.

I claim:

1. An apparatus comprising:

a housing;

an opening in the housing for receiving an object;

a bag dispensing system for storing and supplying a bag, wherein the bag includes a bag opening and a gas vent;

a delivery system connecting the opening in the housing with the bag opening for transporting the object from the opening in the housing through the bag opening into the bag;

a bag closing system for sealing the bag opening, wherein the object is trapped within the bag;

a crushing system for pulverizing the object within the bag;

a discharge system for carrying the bag from the bag crushing system to an exit port in the housing;

a control system for starting and stopping the bag dispensing system, the bag closing system, the bag crushing system, and the bag dispensing system; and a power supply for supplying power to the apparatus.

2. The apparatus of claim 1, wherein the gas vent in the bag includes perforations.

3. The apparatus of claim 2, wherein the perforations are in a pattern forming a pouring opening in the bag when a pouring section is torn off the bag.

4. The apparatus of claim 3, further including a grip section on the pouring section of the bag for allowing a practitioner to grasp the pouring section.

5. The apparatus of claim 4, wherein the grip section on the bag includes a plurality of protrusions.

6. The apparatus of claim 1, wherein the apparatus further includes a door apparatus for covering and uncovering the opening in the housing, wherein the door apparatus is operated by the control system, and is supplied with power by the power supply.

7. The apparatus of claim 1, wherein the crushing system includes an impact mallet for pulverizing the object.

8. The apparatus of claim 1, wherein the crushing system includes a roller apparatus for pulverizing the object.

9. The apparatus of claim 1, wherein the crushing system includes a pressure member for pulverizing the object.

10. The apparatus of claim 1, wherein the bag includes a zipper closure.

11. The apparatus of claim 1, wherein the bag closing system includes a heat sealing member.

12. The apparatus of claim 10, wherein the bag closing system includes a system for grasping and moving a tab on the zipper closure for opening and closing the bag opening.

13. The apparatus of claim 1, wherein the control system includes a control button mounted on an exterior surface of the housing.

14. The apparatus of claim 1, wherein the power supply includes a battery.

15. The apparatus of claim 14, wherein the battery is a rechargeable battery.

16. The apparatus of claim 1, wherein the object is a medicine tablet.

17. The apparatus of claim 1, wherein the housing includes a noise reduction material attached to the inside of the housing and a plurality of resilient feet attached to an outside surface of the housing.

18. The apparatus of claim 1, wherein the delivery system includes a delivery funnel.

* * * * *